United States Patent [19]

Wagner

[11] Patent Number: 4,989,660

[45] Date of Patent: Feb. 5, 1991

[54] LIFT LINK GATE HAVING A PLURALITY OF TABULAR GATE ELEMENTS

[76] Inventor: Hugo Wagner, Kapuzinerstrasse 84e, A-4021 Linz, Austria

[21] Appl. No.: 312,611

[22] Filed: Feb. 17, 1989

[30] Foreign Application Priority Data

Feb. 2, 1988 [AT] Austria ..... 391/88

[51] Int. Cl.[5] ..... E05D 15/06

[52] U.S. Cl. ..... 160/201; 160/232

[58] Field of Search ..... 160/201, 229.1, 40, 160/232

[56] References Cited

U.S. PATENT DOCUMENTS

| | | | |
|---|---|---|---|
| 2,263,995 | 11/1941 | Katulski | 160/201 X |
| 2,300,265 | 10/1942 | Siess | 160/201 |
| 2,549,301 | 4/1951 | Ferrell et al. | 160/201 |
| 2,871,932 | 2/1959 | Stroup | 160/229.1 X |
| 3,103,967 | 9/1963 | Gaschen | 160/201 X |
| 3,148,724 | 9/1964 | Chieger et al. | 160/201 X |
| 3,198,242 | 8/1965 | Crosswell | 160/229.1 X |
| 3,941,180 | 3/1976 | Thill | 160/229.1 |
| 3,967,671 | 7/1976 | Stanley et al. | 160/201 X |

FOREIGN PATENT DOCUMENTS

| | | |
|---|---|---|
| 382432 | 7/1986 | Austria . |
| 2106063 | 8/1971 | Fed. Rep. of Germany . |

*Primary Examiner*—David M. Purol

*Attorney, Agent, or Firm*—McAulay Fisher Nissen & Goldberg

[57] ABSTRACT

The invention relates to a lift link gate having a plurality of tabular gate elements 1, 1' which are joined together by joints or hinges 14 about horizontally extending pivot axes (a). The gate slides with the aid of guide pins or rollers 3 in lateral guide tracks 4 which guide the gate from a vertically closed position along an arcuate path into a horizontal open position. To avoid finger injuries in the deflection area of the gate elements, there is provided at the upper edge 5 of each gate element 1 a tooth-like projection 7 substantially symmetrical relative to the gate center plane which has a front flank 10 ascending up to the tooth tip 9 and a rear flank 12 descending from the tooth tip to the rear face 11 of element 1 and at the lower upper edge 6 at least one depression 13 complementary to the projection of the adjacent element 1' is provided, there occuring, upon pivoting of the elements 1, 1' in the arcuate path area of the guide track 4, only an aperture spacing d which precludes the wedging of a finger therein.

18 Claims, 2 Drawing Sheets

LIFT LINK GATE HAVING A PLURALITY OF TABULAR GATE ELEMENTS

BACKGROUND OF THE INVENTION

1. Field of the Invention

This invention relates to a lift link gate having a plurality of tabular gate elements joined together.

More particularly, the invention is concerned with a plurality of tabular gate elements which are joined together by means of joints, hinges, or the like, about a horizontally extending pivot axis. Specifically, each pair of adjacent elements are joined together by the aforesaid joints, and the gate elements are provided with pins or rollers which are adapted to slide in lateral guide tracks for guiding the gate from a vertical or vertically closed position, then along an arc into a horizontally open position which is orthogonally related to the closed position.

2. Description of the Prior Art

When the gate elements move from a vertical to a horizontal position, the adjacent gate elements have their spacing therebetween changed so that upper and lower edges of respective adjacent gate elements are spaced from each other in accordance with a mutual tilt and, as the gate elements come together along the arc, the rear end of one gate element approaches the front end of the next adjacent gate element and the fingers of a user may be wedged in and dangerous injuries may result. Examples of prior art in which this type of difficulty exists are those such as set forth in U.S. Pat. No. 2,880,796, Federal Republic of Germany No. DE-OS 1509191.

The prior art has proposed various solutions to avoid the wedging of a finger between adjacent gate elements, and none of these do appear to be satisfactory. One suggested possibility for avoiding such injuries is disclosed in Austrian No. AT-PS 382,432. According to the disclosure of the Austrian publication, and other examples like it, specific edge sections are used to provide for a hinge-type joining of the gate elements, so that there remains at a front face of the closed gate, a distance between the upper and lower edges of adjacent gate elements, respectively; this is of a size generally to preclude the pinching of a finger. The disadvantage of the aforesaid heretofore known lift link gate is that the edge sections used are relatively costly and the closed gate has on its outer face inwardly recessed horizontal grooves which often are undesirable for aesthetic reasons.

The prior art has also provided for mutually facing edges of gate elements, a step so as to provide for a better heat insulation in the region of the closure (see, for example, Federal Republic of Germany No. DE-OS 2106063 Austrian No. AT-PS 369129). While these steps can improve the heat insulation, they do not help to avoid the danger of finger injuries.

SUMMARY OF THE INVENTION

It is therefore an object of the invention to provide a lift link gate wherein a good seal between the adjacent gate elements exists and finger injuries in the deflection area of the gate elements can be avoided.

This objective can be achieved with a lift link gate of the initially mentioned kind wherein, according to the invention, and considering movement in a first or upward direction at an upper edge of each gate element, there is provided a tooth type projection substantially symmetrical relative to the gate center plane which has a front flank ascending to the tip of the tooth and a rear flank descending from the tip of the tooth to the rear face of the element. And, at the lower edge, at least one depression adapted to the projection of the adjacent element is provided, so that upon tilting of the elements in the arc region of the guide tracks between the vertical and horizontal orientation of the tracks only an aperture spacing is provided which precludes and effectively prevents the wedging therein of a finger.

The gate elements have been described in such a manner that the tooth projection is on the trailing adjacent link. The tooth projection could very well be at the bottom of the leading adjacent link. Therefore, it is within the scope of the invention to provide the lower edge of each gate element with a tooth-type projection substantially symmetrical relative to the gate center plane which has a front flank descending to the tip of the tooth and a rear flank ascending from the tip of the tooth to the rear face of the element. And, at the upper edge, at least one depression is adapted to the projection of the adjacent element so that, upon tilting of the elements in the arc region of the guide tracks between the vertical and horizontal orientation of the tracks, only an aperture spacing is provided to prevent the wedging therein of a finger.

According to the invention, the new form of the upper and lower edges of the gate elements makes it possible to place the pivot axis so that in the arc region of the guide tracks only a small aperture spacing or aperture results between adjacent gate elements, for example a spacing of 4 mm as a maximum, so that fingers cannot inadvertently get into the aperture region. Moreover, with the present invention, the ascending front face additionally brings about that fingers engaging in the aperture region slip off easily and do not "get stuck" in a dangerous part of the aperture region. The tooth system between the gate elements results not only in a good seal in the closed state, but also in a centering effect which helps to compensate tolerances of the elements and/or their lateral guides. Further, a good mutual support of the elements exists, which comes into play especially when individual elements are weakened by glass window openings. The symmetrical design leads to a simplified production, especially when each element is made of two sheet metal shells, as these can then be of identical form.

To these ends, the invention comprises a lift link gate for use with lateral guide tracks, including a plurality of tabular gate elements joined together by hingedly connected joints with each of the hingedly connecting joints extending about a horizontally extending pivot axis, each said gate element having a front face and a rear face; guides coupling the gate elements for sliding movement in the lateral guide tracks for guiding the lift link gate in a vertically direction out of a vertically closed position along an arc path region into a horizontal direction to a horizontal open position; and, in a first direction of movement, an upper edge of each gate element except the leading gate element includes at least a tooth-like projection substantially symmetrical relative to the gate center plane and having a tooth tip and front flank ascending from the front face up to the tooth tip and a rear flank descending from the tooth tip to the rear face of the gate element; each gate element at the lower edge thereof, except the last gate element, having at least one depression complementary to the projection of a next adjacent gate element for receiving therein the projection of the adjacent element; and an aperture region provided between the adjacent elements which aperture region provides an aperture spacing precluding the wedging of a finger therein, upon pivoting of any two adjacent elements in the arc path region of the guide track.

BRIEF DESCRIPTION OF THE DRAWINGS:

In order that the invention will be more readily understood, the same will now be described in connection with the accompanying drawings in which.

Figure 1:
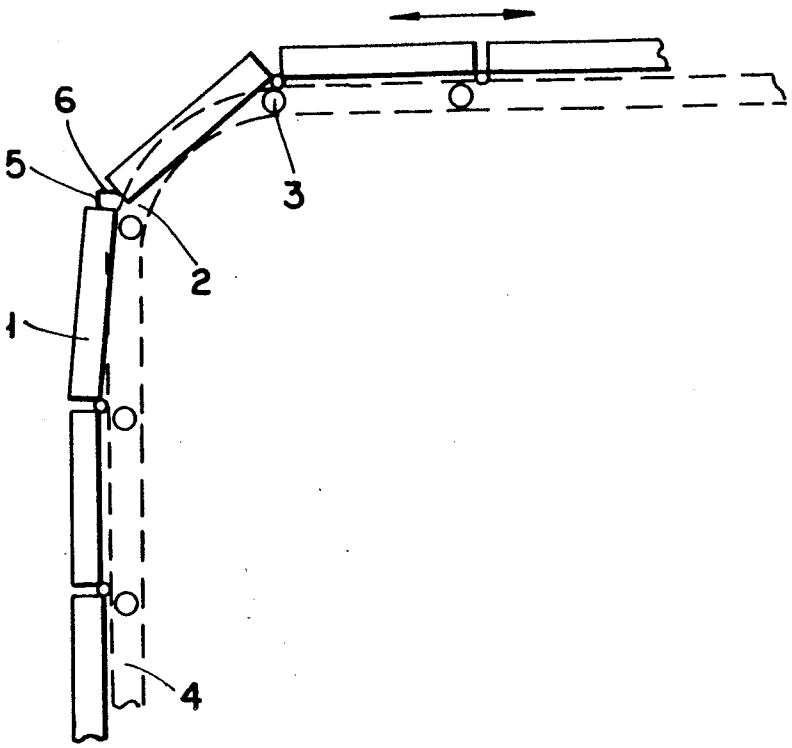
FIG. 1 is a schematic side view of a portion of the vertical track and horizontal track together with the arc region joining the vertical and horizontal tracks and the means guiding the gate elements of a lift link gate in the arc region between the vertical and horizontal tracks.

DESCRIPTION OF THE REFERRED EMBODIMENTS:

Referring now more particularly to FIG. 1 of the drawing which illustrates a presently preferred mode for carrying out the invention, there is shown a lift link gate generally consisting of at least two and preferably a plurality of individual gate elements 1 which are joined together by means of hinges, joints or the equivalent 2; the respective pivot axis of each joint 2 extends horizontally. Coupled with hinges or joints 2 are guide rollers 3 which are guided along lateral guide rails 4 or similar guide tracks.

In the gate opening area, guide rails 4 are shown as extending in a vertical direction and change over along an arc portion or region to a horizontal portion. In order to close the gate, the interconnected adjacent elements 1 are brought from the horizontal rail portion into the vertical portion. As can be seen from FIG. 1, in accordance with the mutual tilt of the gate elements 1, their adjacent upper and lower edges 5, 6 of adjacent gate elements are spaced from each other or agape. If, during the closing movement of the gate, the fingers of a user get into the respective gap, the fingers may be wedged in, as the edges come together again in the course of the closing movement.

The movement of the gate may be controlled either manually or it may be motorized. It should also be understood that like or similar parts in all of the various embodiments are designated with the same reference numeral.

Figure 2:
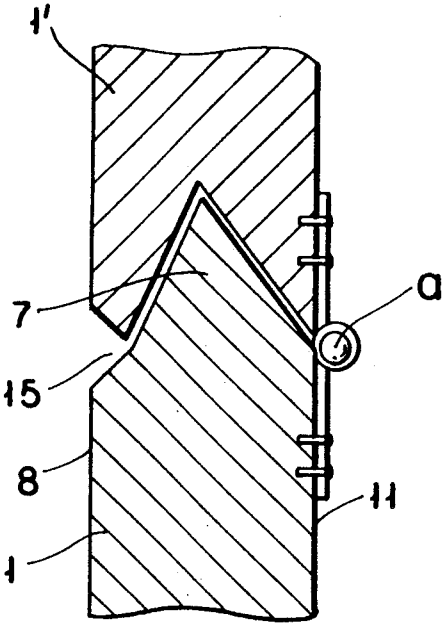
FIG. 2 is a schematic sectional view of one embodiment of two adjacent gate elements of a lift link gate according to one embodiment of the invention shown in their position when travelling along a straight portion of the vertical or horizontal track and the joint element joining the two adjacent gate elements.
Figures 3, 4, 5, 6:
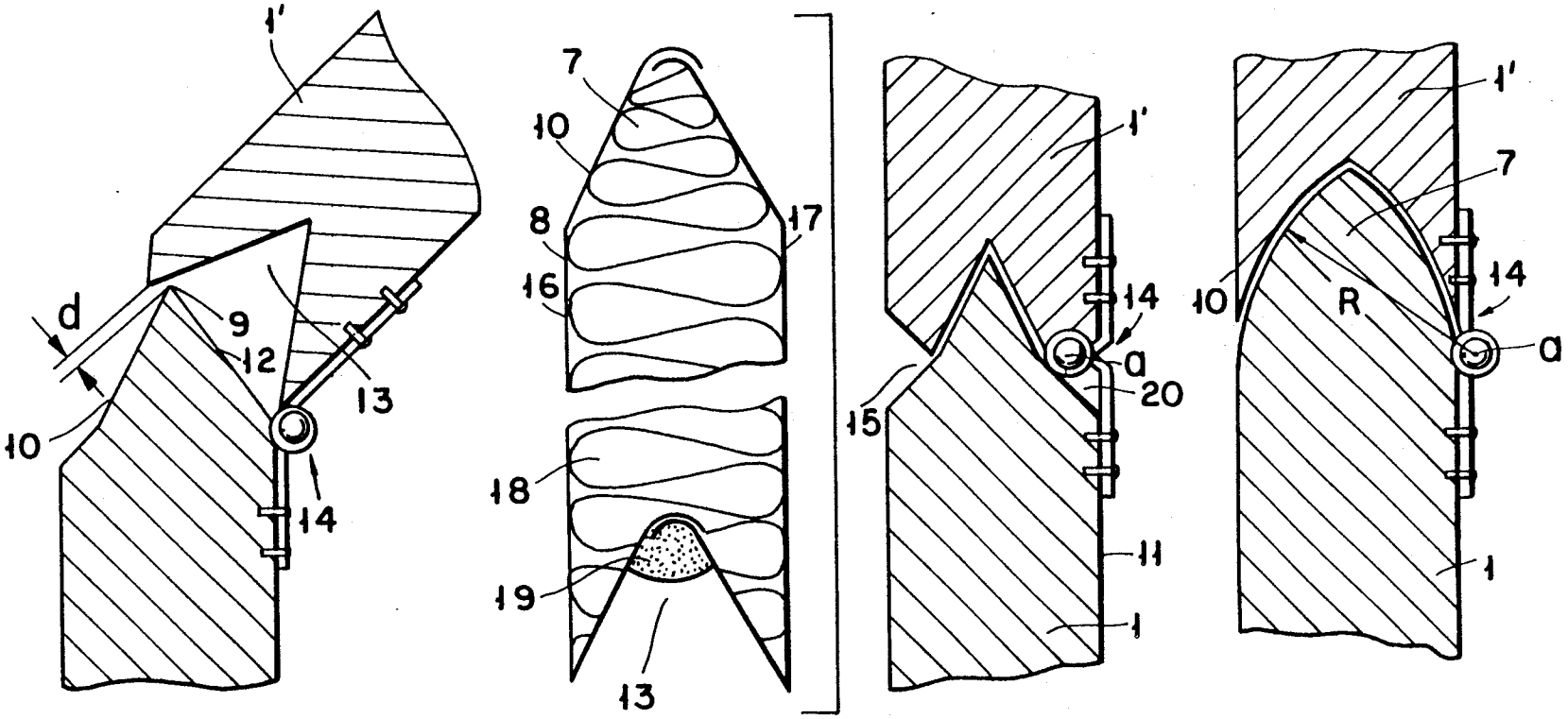
FIG. 3 is another view of the two adjacent gate elements of the lift link gate shown in FIG. 2 with the adjacent gate elements somewhat displaced from each other and pivoting about the hingedly connected joint to indicate their position in the arc region joining the horizontal and vertical track portions, with the two adjacent elements tilted relative to each other so as to enable them to move along the arc region.
FIG. 4 is a view of another embodiment of the gate element shown in FIG. 2 and is a modification of a single gate element shown partially in section and partially schematically.
FIG. 5 is another embodiment which is a modification of the lift link gate of FIG. 2 showing two adjacent gate elements together with a different hingedly connected joint means joining the two adjacent elements.
FIG. 6 is a further modification showing another embodiment of two adjacent gate elements with a hingedly connected joint means similar to the joint means of FIGS. 2 and 3, but with a modified mating portion.

Referring now more particularly to FIGS. 2 and 3, two adjacent gate elements are shown with the upper gate element designated as 1' and the lower gate element designated as 1. The lower edge of lower gate element 1 will be the same as the lower edge of its next adjacent 10 upper gate element 1' and is not shown. In a similar manner, the upper edge of upper gate element 1' is the same as the upper edge of gate element 1. Accordingly, reference numerals 1 and 1' have meaning only when discussing two adjacent gate elements.

In the embodiment of FIGS. 2 and 3, each gate element 1 has at its upper edge 5 an upwardly extending projection 7 having a cross-section; and, in the present invention, it is shown as a triangular cross-section. The projection 7 has a front face 8, a tooth tip 9 and a front flank 10 originating from the front face 8 of element 1 and ascending up to the tooth tip 9. Tooth projection 7 comes to a point at tip 9. Gate element 1 has a rear face 11 similar to front face 8 and a rear flank 12 descending from the tooth tip 9 to the rear face 11. At the lower edge 6 of the adjacent element 1' as shown, and also at the portion of element 1 itself (not shown), a depression 13 is provided whose form is adapted to and complementary to the projection 7. The terms "top" and "bottom" used in the specification and claims in connection with the gate elements refer to the gate in its closed position, i.e., when the elements are in their vertically extending position.

Hinge 14 is provided for connecting elements 1, 1' together. Hinge 14 is fastened by straps to one of the elements 1, 1'. As best seen in FIG. 3, upon tilting of the elements 1, 1' so that they are not vertically aligned, there results in the arc region of the guide rails 4 maximum tilt angles of about 60° and only an aperture region having a small aperture spacing d between upwardly extending projection 7 and one side edge of depression 13, which, e.g., by varying the position of the horizontal pivot axis a of the hinges 14 is adjustable to about 4 mm. This small spacing of 4 mm prevents fingers of a user from getting in between the edges of adjacent elements and becoming injured; this effect is supported by the ascending flank 10 along which the fingers of a user slide off.

By bevelling the lower edge of one side of the depression remote from the hinged portion 14 as well as the lower portion of the upwardly extending projection 17, there is formed a recess 15. Accordingly, as can be seen from FIGS. 2 and 3, that because of the corresponding bevels of the two adjacent gate elements, there remains in a closed position the recess 15 in the region of the closure of the adjacent elements 1, 1' on the front side. Recess 15 improves the appearance of the closed gate.

Referring now to FIG. 4, there is shown a single gate element 1 which consists of two sheet metal shells 16, 17 with an inserted insulation 18. This insulation 18 is either glued to the sheet metal shells 16, 17 or it is introduced into the sheet metal shells by foaming. This results in a high stability of element 1 combined with low weight. As can be seen, the sheet metal shells 16, 17 may be of identical design, thereby simplifying their manufacture. The connection between the sheet metal elements 16, 17 may alternatively be by means of a snap connection. While only a single gate element 1 is shown, it is to be understood that the gate element is usable with another similar gate element as described in connection with the FIGS. 2 and 3 embodiment. Element 1, like the one in the FIGS. 2–3 embodiment, has at its upper edge a triangular projection 7 and at its lower edge a corresponding depression 13. As shown, for this element, in the gore or base of depression 13 associated with tooth tip 9, there is provided a seal strip 19 extending over the total width of the element which may be inserted into the gore and it may be glued in the gore. Seal strip 19 consists of an elastic, soft plastic material which both improves the heat insulation at the joints of the elements and counteracts the penetration of moisture.

Referring now more particularly to FIG. 5, another embodiment is shown in which a further recess 20 is provided in addition to recess 15. Rear recess 20 can receive the joint of hinge 14, so that the pivot axis a lies in front of the rear face 11 of the elements 1, 1'. In all other respects, this embodiment with elements 1, 1' is generally similar to the embodiment shown in FIGS. 2 and 3. With hinge 14 in recess 20, less space is required for the width of the links or connection linking of the two gate elements 1, 1'. Recess 15 still performs the same function as described in connection with the FIGS. 2–3 embodiment.

Referring now more particularly to FIG. 6 of the drawing which shows a modification of the tooth-shaped upwardly extending projection 7, in this embodiment, both the front and rear flanks of projection 7 curve along an arc of a circle. A radius of curvature R is shown for the front flank, and this radius of curvature has its center located at the axis a in hinge or joint 14.

When the center of curvature or radius of curvature R coincides with the pivot axis a, there will be during the pivoting movement of the elements 1, 1' no change at all in the distance between the front flank 10 of the projection of an element 1 and the associated depression 13 of the adjacent element 1', so that this distance, taking into consideration of the manufacturing tolerances, can be minimized practically ad libitum.

It should be noted that the elements 1, 1' may be pivotably interconnected by the usual hinges or by special shaped sections as disclosed in U.S. Pat. No. 2,880,796. It is possible also, however, that the pivoting connection between the elements is brought about only laterally, next to the gate opening or respectively in the rail region by special straps or the like. Such a design, which is possible because of a good support of the elements formed according to the invention, is recommended for correspondingly rigid elements or respectively not overly wide gates. The elements themselves may be double-walled with or without insulation, single-walled, e.g., of sectional sheet-metal, or solid, e.g., of wood or plastic or in composite construction.

It is also possible for the lower edge of the bottommost gate element to be generally flat, but it need not be so. The same also applies to the upper edge of the upper gate element. On the other hand, to simplify manufacture, the bottommost and the topmost gate element may be identical with the other elements. It is also possible to use the elements upside down, i.e., e.g., in the embodiment according to FIGS. 2 and 3 with projection 7 extending in a downwardly direction, although such a design is inappropriate if splash water and condensation may occur.

While there has been shown what is presently considered to be the preferred embodiments of the invention, it will be obvious to those skilled in the art that various changes and modifications may be made therein without departing from the scope of the invention.

I claim:

1. A lift link gate having a plurality of tabular gate elements joined together on their back sides by hinge means with each said hinge means extending about a horizontally extending pivot axis for use with lateral guide tracks and guide means coupling the gate elements for sliding movement in said lateral guide tracks for guiding the link gate out of a vertically closed position in a vertical direction and then along an arcuate path region and then in a horizontal direction into a horizontal open position, comprising:

each said gate element including a front face and a rear face, and in a first direction of movement in the vertical direction an upper edge of each said gate element includes a tooth-like projection extending from said front face up to said next adjacent gate element in said first direction of movement in the vertical direction and substantially symmetrical relative to a gate center plane and having a tooth tip, a rear flank, and a front flank ascending up to said tooth tip, said rear flank descending from said tooth tip to said rear face of said gate element;

each said gate element having at a lower edge thereof in a direction opposite to said first direction of movement at least one depression complementary to said projection of a next adjacent gate element for receiving therein the projection of said next adjacent element;

an aperture region provided between said adjacent elements which includes an open aperture spacing precluding the wedging of a finger therein, upon pivoting of said two adjacent elements in said arcuate path region of the guide track; and each of said gate elements consists of two formed sheet metal shells and connection means joining said sheet metal shells together.

2. The lift link gate according to claim 1, including:

a seal strip;

a gore in said depression associated with said tooth tip of a next adjacent gate element; and said seal strip being inserted into said gore at a rear end of the gate element associated with the tooth tip of the next adjacent gate element.

3. The lift link gate according to claim 1, wherein said tooth tip comes to a point, and said front flank of the tooth-like projection is convexly curved and terminates at said point and has a substantially circular cross section, a center of a radius of curvature of said convexly curved front portion lying substantially in the respective pivot axis.

4. The lift link gate according to claim 1, wherein at least one of said two adjacent elements has on a front side and in a region of the closure a continuous recess, and said hinge means being external of said recess.

5. The lift link gate according to claim 1, wherein at least one of said two adjacent elements has on a rear side and in the region of a closure a continuous recess.

6. The lift link gate according to claim 1, wherein at least one of said two adjacent lements has on both the front and a rear side and in the region of the closure a continuous recess, said hinge means being external of said continuous recess on said back sides.

7. The lift link according to claim 1, wherein said recess has a triangular cross section.

8. The lift link according to claim 5, wherein said recess has a triangular cross section.

9. The lift link according to claim 6, wherein said recess has a triangular cross section.

10. The lift link gate according to claim 3, wherein at least one of said two adjacent elements has on a front side and in a region of the closure a continuous recess.

11. The lift link according to claim 10, wherein said recess has a triangular cross section.

12. The lift link gate according to claim 3, wherein at least one of said two adjacent elements has on a rear side and in a region of the closure a continuous recess, said hinge means being external of said continuous recess.

13. The lift link according to claim 12, wherein said recess has a triangular cross section.

14. The lift link gate according to claim 3, wherein at least one of said two adjacent elements has on both a front and a rear side and in a region of a closure a continuous recess.

15. The lift link according to claim 14, wherein said recess has a triangular cross section.

16. The lift link gate as claimed in claim 1, wherein said aperture spacing is adjustable to about 4 mm, as a minimum.

17. The lift link gate element according to claim 1, wherein said formed sheet metal shells are identical.

18. A lift link gate for use with lateral guide tracks, including:

a plurality of tabular gate elements joined together by hingedly connected joint means with each said hingedly connected joint means extending about a horizontally extending pivot axis, each said gate element having a front face and a rear face;

guide means coupling said gate elements for sliding movement in said lateral guide tracks for guiding the gate in a vertical direction out of a vertically closed position along an arc path region into a horizontal direction to a horizontal open position;

in a first direction of movement, an upper edge of each gate element except a leading gate element includes a tooth-like projection substantially symmetrical relative to a gate center plane and having a tooth tip and front flank ascending from said front face up to said tooth tip and a rear flank descending from said tooth tip to said rear face of said gate element;

each said gate element at a lower edge thereof, except a last gate element, having at least one depression complementary to said projection of a next adjacent gate element for receiving therein the projection of said adjacent element;

an aperture region provided between said adjacent elements which aperture region provides an aperture spacing free of any other material to take up said aperture spacing precluding the wedging of a finger therein, upon pivoting of any two said two adjacent elements in said arc path region of the guide track;

said tooth tip coming to a point, and said front flank of the tooth-like projection being convexly curved and terminating at said point and having a substantially circular ross-section, a center of a radius of curvature of said convexly curved front portion lying substantially in the respective pivot axis;

at least one of said two adjacent elements having on a rear side and in a region of the closure a continuous recess with a triangular cross-section, said hinge means being external of said continuous recess; and said gate elements consisting of sheet metal shells including connection means for joining them together.

* * * * *